United States Patent [19]

Varnell

[11] 3,987,807

[45] Oct. 26, 1976

[54] TELESCOPIC WALKING CANE

[76] Inventor: Dennis H. Varnell, 6060 E. Berry Ave., Englewood, Colo. 80110

[22] Filed: Nov. 10, 1975

[21] Appl. No.: 630,708

[52] U.S. Cl. ..... 135/66; 135/22; 135/75; 211/105.6; 248/188.5; 403/109; 403/166; 403/330

[51] Int. Cl.[2] ..... A45B 1/04; A45B 19/04; A45B 3/00

[58] Field of Search ..... 135/45 R, 46 T, 47, 135/22, 24; 248/188 J, 359, 360; 211/105.6; 403/330, 107, 109, 166, 353

[56] References Cited

UNITED STATES PATENTS

| | | | |
|---|---|---|---|
| 1,632,639 | 6/1927 | Weise | 135/46 T |
| 2,650,120 | 8/1953 | Kirkpatrick | 403/330 |
| 3,612,464 | 10/1971 | Harrah | 248/360 |
| 3,658,076 | 4/1972 | Yasada | 135/24 |

FOREIGN PATENTS OR APPLICATIONS

| | | | |
|---|---|---|---|
| 486,984 | 3/1918 | France | 135/47 |
| 909,552 | 5/1946 | France | 135/47 |

*Primary Examiner*—Werner H. Schroeder
*Assistant Examiner*—Conrad L. Berman

[57] ABSTRACT

A telescopic walking cane with spring-loaded telescopic members that can be easily telescoped to provide a cane compact for carrying purposes and which likewise can be readily telescoped to full length by activation of a hand switch for walking purposes, the telescopic walking cane being provided with a concealed latch that can be readily opened for fastening to a person's belt or other convenient location on the person's wearing apparrel for ease in carrying or storing said walking cane when not in use, a thermometer built into the side of the walking cane for convenience in reading air temperature as particularly useful for individuals with certain handicaps affected by the weather, the walking cane being further provided with a scale or ruler markings along its length, and, additionally, a battery operated light at the tip of the walking cane operated by a switch in the handle, said light being useful when necessary for a handicapped person to look in dark corners or areas.

1 Claim, 15 Drawing Figures

10
11
12
13
14
15
17
18
20
21
22
23
24
25
26
30
31
32
33
34
35
36
37
41
5

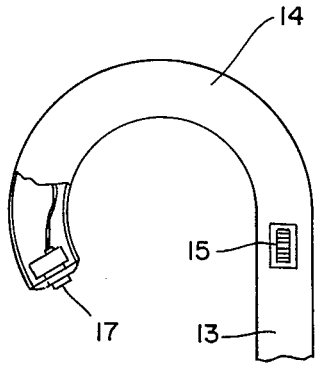
FIG. 10
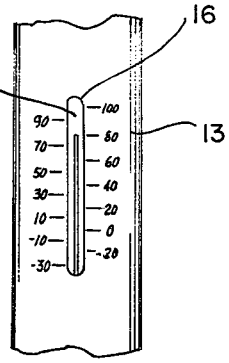
FIG. 7
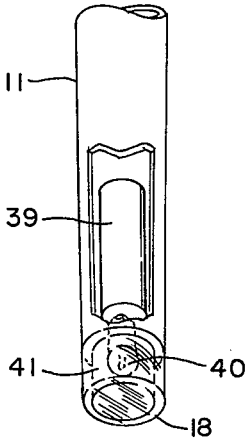
FIG. 9
FIG. 8
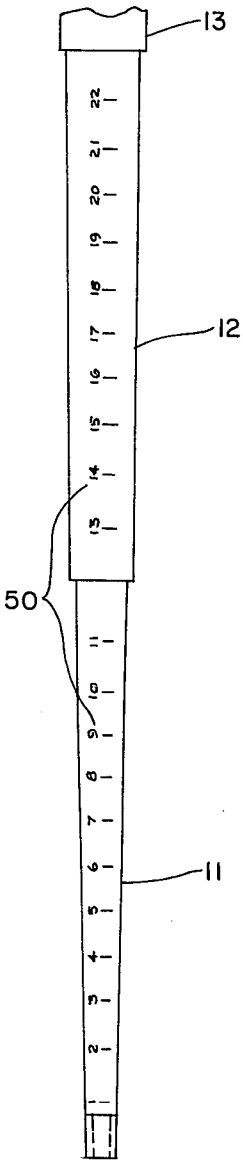

TELESCOPIC WALKING CANE

BACKGROUND OF THE INVENTION

1. Field of the Invention

This invention relates to a telescopic walking stick used particularly by handicapped persons with features helpful to easing the everyday burdens of handicapped individuals.

2. Description of the Prior Art

Most walking sticks today are manufactured in one solid piece, usually of wood or metal. Little or no other features are incorporated into the walking stick so that its sole purpose is to help a handicapped person walk more easily. Using such walking sticks, the handicapped person must find some place to store the walking cane when it is not in use, such as over the back of a chair, on a hanger, etc, thus often causing an obstacle to themselves and to nearby persons. Moreover, some handicapped persons need to use a walking cane only part of the time so that, with the use of most conventional canes, the walking stick must be carried by the handicapped individual even at times he does not desire to use it. Telescopic walking sticks are described in previous art, but they are generally complex telescopic mechanisms and, consequently, usually difficult to telescope into a compact position. Additionally, most telescopic walking sticks do not provide other features which might be useful to the handicapped person.

SUMMARY OF THE INVENTION

The present invention provides a novel telescopic walking cane for use by handicapped or semi-handicapped individuals with an easy method of telescoping the walking cane into a walking position and of returning the cane from an extended position to a compact position for carrying or storing purposes.

A feature of the present invention is to provide users of walking canes with helpful features, notably a hidden latch hook for easy carrying or storage of the walking stick when not in use, a thermometer for telling temperatures, a built-in scale or ruler for measuring distances, a light on the tip of the cane for illumination of dark areas or corners.

A feature of the present invention provides a telescopic walking cane which is easy to use and reliable and efficient in operation.

Yet still a further feature of this invention provides a telescopic walking cane which is of a rugged and durable construction and which, therefore, may be guaranteed by the manufacturer to withstand rough usage.

Other features of this invention will be apparent during the course of the following description.

BRIEF DESCRIPTION OF THE DRAWINGS

In the accompanying drawings forming a part of the specification, and in which like reference characters are employed to designate like parts throughout the same:

FIG. 7 is a perspective view of the thermometer built into the side of the walking cane; and FIG. 8 is a partial perspective view of the scale or ruler printed along the length of the walking cane; and FIG. 9 is a fragmentary view of the battery operated light in the tip of the walking cane; and FIG. 10 is a fragmentary view of the handle of the walking cane with the telescopic release switch and light switch.

DESCRIPTION OF THE PREFERRED EMBODIMENT

Figures 1, 2, 3, 4, 5, 6:
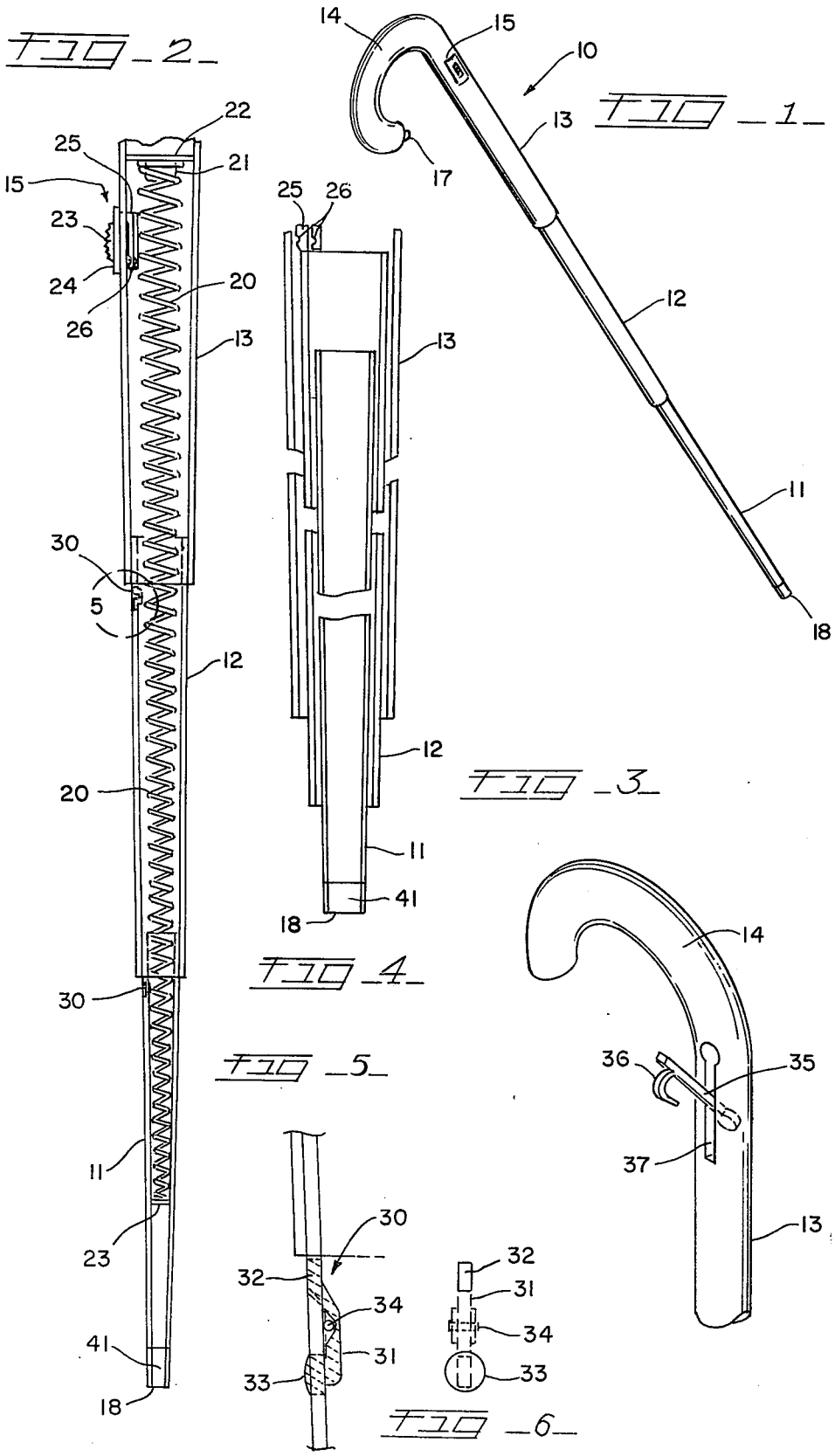
FIG. 1 is a perspective view of the telescopic walking cane in the extended position.
FIG. 2 is a sectional view of the cane spring-loaded mechanism.
FIG. 3 is a partial sectional view of the telescopic member of the cane in a compact position.
FIG. 4 is a perspective view of the concealed latch in the open position.
FIG. 5 is a sectional side view of the telescoping latch mechanism.
FIG. 6 is a sectional end view of the telescoping latch mechanism.

Referring now to the drawings in detail, there is illustrated a preferred form of the telescopic walking cane constructed in accordance with the principles of the present invention, and which is designated generally in its entirety by the reference numeral 10 and which is comprised of 3 telescoping cylindrical members, telescoping member 11 being of less diameter than telescoping member 12 with the outside diameter of telescoping member 12 less than the inside of telescoping member 13, thus enabling telescoping members 11 & 12 to telescope into telescoping member 13 when in the compact position. Telescoping member 13 is rounded or curved at the top of the cane to provide handle 14, with the telescoping member 13 also including telescoping switch 15, the built-in thermometer 16, and the light switch 17 at the tip of the handle, and telescoping member 11 being provided with battery operated light 40 at its bottom tip.

The telescoping spring 20 is incorporated inside the walking cane 10 and is secured inside and toward the top of the telescoping member 13 by pin 21 which in turn is fastened to plate 22 which is secured in position in the upper portion of telescoping member 13. The bottom of spring 20 is compressed against plate 23 which is secured toward the bottom inside of telescoping member 11.

The telescoping switch 15 is of durable plastic or metal material consisting of a knurled knob 23, and outside plate 24, and a dual latch 25 constructed of spring steel with double indents 26 at the bottom of latch 25, the telescopic switch 15 being assembled through a slotted hole (not shown) in telescopic member 13. The telescoping lock switch designated by the numeral 30 is constructed of durable metal material and consists of an irregular U-shaped bracket 31 with the top pivot button 32 and the bottom pivot button 33, with the top pivot button 32 being positioned within a rectangular through slot 42 and the bottom pivot button 33 being positioned in a round through hole 43, with the slot 42 and the hole 43 being identically provided in each of the telescoping members 11 and 12. The telescoping lock switch 30 is attached on the insides of each of the telescoping members 11 and 12 by means of pivot pin 34 which is secured in any conventional way such as to a support bracket 44 which, in turn, is securely affixed, such as by welding, to the inside of each of members 11 and 12 with the pivot pin 34 conventionally attached thereto and through the U-shaped bracket 31 to provide free rotation of the bracket 31 on pivot pin 34.

The concealed latch 35 consists of durable plastic or metal material to which is securely attached hook 36, the latch being assembled near the top of telescoping member 13 in the slotted hole 37. The thermometer 16 is a conventional thermometer also affixed within a slotted hole 38 toward the top of telescoping member 13.

The light switch 17 is a conventional push-type electric contact switch built into the tip of handle 14 and is connected by wires (not shown) through the length of the telescoping walking cane 10 to the battery operated light 18 at the bottom tip of telescoping member 11, the light 18 consisting of a conventional type flashlight battery 39, a conventional flashlight-type bulb 40, and a clear glass or plastic lens 41.

Scaled or ruled measurements 50 are printed or embossed in inches along each of the telescoping members 11, 12, and 13, with the measurements progressing from the bottom of the cane.

Figure 11:
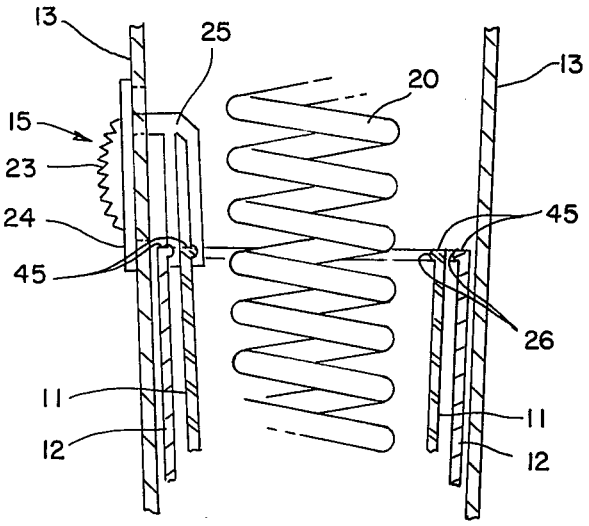
FIG. 11 is a partial cut-away view of the telescoping members contracted in a locked position.
Figure 12:
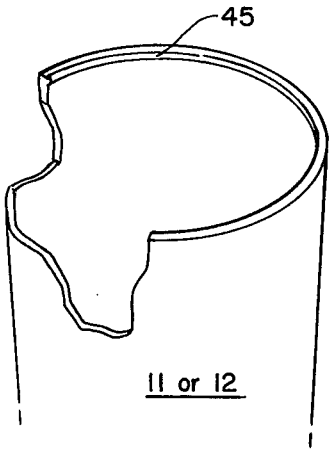
FIG. 12 is a partial cut-away perspective view of the top portion of either of the two smaller telescoping members.
Figure 13:
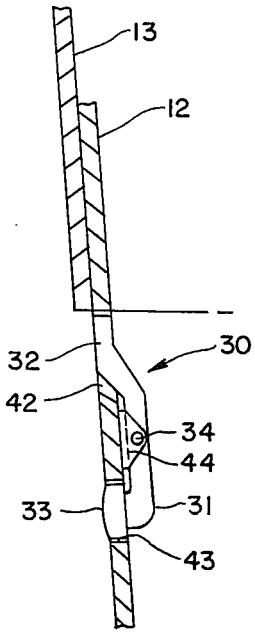
FIG. 13 is a side sectional view of the telescoping lock switch in the unlocked position.
Figure 14:
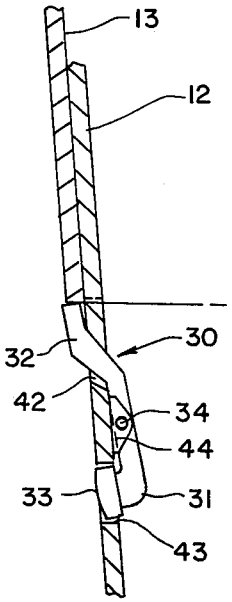
FIG. 14 is a side sectional view of the telescoping lock switch in a locked position.
Figure 15:
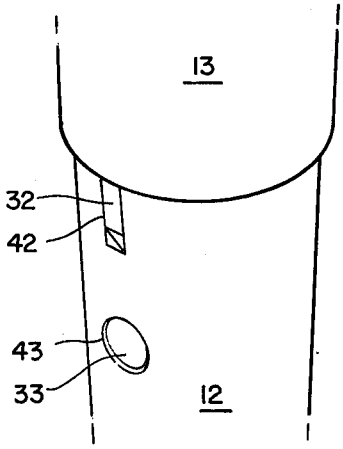
FIG. 15 is a perspective view of the telescoping lock switch as viewed on the outside of a telescoping member.

In operation, the telescopic walking cane 10, when not in use, is carried by the user in a compact position, this being illustrated in FIG. 11 with the top inside surface 45 of each of the telescopic members 11 and 12 being provided with a small flange around their respective inside diameters and being snapped into a locked position into the double indents 26 provided on the dual latch 25. In order to use the telescopic walking cane 10, the telescoping switch 15 is pushed by the user in an upward position along telescoping member 13 to release the tops of telescoping members 11 and 12 from the dual latch 25, spring 20 thereby forcing telescoping members 11 and 12 into an extended or telescoped position. Also, when the telescopic walking cane 10 is not in use, the telescoping lock switch 30 provided on telescoping members 11 and 12 is in an unlocked position, as shown in FIG. 13, so that the top pivot button 32 and the bottom pivot button 33 are flush with the outside diameter of telescoping members 11 and 12 so as to allow member 11 to telescope within member 12 and to allow member 12 to telescope within member 13. When the telescopic walking cane 10 is extended into a use position, bottom pivot button 33, as shown in FIG. 14, is then pushed inwardly of telescoping members 11 and 12 thereby causing the top pivot button 32 to be forced outwardly of telescoping members 11 and 12 to lock telescoping member 11 in place against the bottom of telescoping member 12 and to lock telescoping member 12 in position against the bottom of telescoping member 13 in order to provide the stable walking stick when in use to provide collapsing of telescoping members 11 and 12. In order to collapse the telescopic walking cane 10, the reverse procedure is followed wherein the top pivot button 32 is pushed inwardly of telescopic members 11 and 12 respectively causing the bottom pivot button 33 to be flush with the outside diameter of telescoping members 11 and 12, the user of the cane then holding the handle 14 and forcibly compressing the cane by pushing against the bottom of the cane to force the top inside surfaces 45 of the telescopic members 11 and 12 to become locked in place within the double indents 26 provided on the dual latch 25. When the telescopic walking cane is in the compact position, the top of the concealed latch 35 can be pushed inwardly in the slotted hole 37 to force hook 36 outwardly of telescoping member 13, the hook then being available to hang the telescopic walking cane on a hanger or on a person's wearing apparel for ease of storage or carrying the walking cane when not in use. The built-in thermometer 16 is available on the outside of the telescoping member 13 for the handicapped individual to read the whether whenever desired. Likewise, the ruler measurements 50 are available when the telescopic walking cane 10 is in the extended position as desired by the user. Likewise, when the user of walking cane desires to be able to look in dark crevices or corners, the light switch 17 is depressed to turn the light 18 on or off at the bottom of the walking cane as desired.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention.

Having thus described the invention, what is claimed is:

1. A telescopic walking cane for use by handicapped or semi-handicapped individuals, the cane comprising, in combination:

a series of telescoping members with a conventional type handle at the top of the walking cane, and a spring disposed interiorly of said telescoping members for purposes of telescoping said walking cane; and a telescoping switch for securing said telescoping members in place when said walking cane is in a collapsed position, consisting of a knurled button, an outside plate, and a dual latch provided with double indents at the bottom of said latch for securement of the inside top surface of all but the uppermost telescoping members within said indents, the upper inside surface of said telescoping members being conventionally provided with a flange rim around the diameter of said inside surface; and a series of telescoping lock switches for holding the telescoping members in an extended position and consisting of an irregular U-shaped bracket, a top pivot button, and a bottom pivot button, with said telescoping lock switch affixed to the inside of all but the uppermost telescoping sections by means of a pivot pin mounted to a conventional support bracket; and a concealed hooked latch provided in the top telescoping member for attachment of said walking cane to a hanger or a person's wearing apparel when said walking cane is not in use and with said latch being concealed with the cane in use; and a thermometer built into the side of said walking cane for use by handicapped or semi-handicapped individuals for reading weather temperatures; and ruler or inch measurements provided along the length of said walking cane for measurement of distances as desired by a handicapped or semi-handicapped individuals; and a light provided at the bottom tip of said walking cane, operated by a switch at the tip of the handle of said walking cane, and with said light being battery operated to illuminate dark crevices or corners.

* * * * *